United States Patent [19]

Johnson

[11] Patent Number: 4,690,607

[45] Date of Patent: Sep. 1, 1987

[54] REFUSE COLLECTION TRUCK AND APPARATUS FOR CONTROLLING COMPACTION OF REFUSE

[75] Inventor: Gary Johnson, Fort Payne, Ala.

[73] Assignee: The Heil Co., Milwaukee, Wis.

[21] Appl. No.: 784,846

[22] Filed: Oct. 4, 1985

[51] Int. Cl.[4] ..... B65F 3/28

[52] U.S. Cl. ..... 414/517; 414/525 R; 91/451; 91/517

[58] Field of Search ..... 414/517, 525 R; 91/517, 91/451, 452

[56] References Cited

U.S. PATENT DOCUMENTS 3,049,256 8/1962 Urban ..... 214/518
3,556,324 1/1971 McCarthy ..... 214/152
3,682,336 8/1972 Wieschel et al. ..... 214/83.3
4,522,551 6/1985 Henneberry ..... 91/517 X

*Primary Examiner*—Robert J. Spar
*Assistant Examiner*—Stuart J. Millman
*Attorney, Agent, or Firm*—Fuller, Puerner & Hohenfeldt

[57] ABSTRACT

Apparatus for controlling the compaction of refuse in a refuse collection truck, and for controlling the operation of an ejection panel of the refuse collection truck, so as to provide for uniform compression of refuse in the truck. A hydraulic cylinder supports the ejection panel, and a combination sequence-relief valve is provided to vent hydraulic fluid from the cylinder when the fluid pressure output of the hydraulic pump exceeds a predetermined pressure and when the fluid pressure in the packing cylinder exceeds a selected pressure.

12 Claims, 3 Drawing Figures

REFUSE COLLECTION TRUCK AND APPARATUS FOR CONTROLLING COMPACTION OF REFUSE

FIELD OF THE INVENTION

The present invention relates to refuse collection trucks and to apparatus for compaction of refuse in refuse collection trucks.

BACKGROUND PRIOR ART

Refuse collection trucks commonly include a tailgate device for receiving refuse and for forcing the refuse forwardly into the container of the truck. An example of such a refuse collection truck is illustrated in the Weischel et al. U.S. Pat. No. 3,682,336, issued Aug. 8, 1972. One problem with prior art refuse collection trucks is that material being forced into the truck container is not uniformly compacted. The material at the forward end of the truck is commonly not as tightly compressed as the material at the rearward end of the truck. This reduces the load which can be carried by the truck and reduces the efficiency of operation of the truck.

The Urban U.S. Pat. No. 3,049,256 teaches a refuse compaction structure intended to overcome the problem of variation in the amount of compaction of refuse in a refuse container. The refuse collection truck shown in this patent is provided with a movable ejection plate or panel housed in the refuse container and supported for movement along the length of the container. During initial loading of the truck, the ejection panel is positioned at a rearward portion of the truck, and the refuse material can be compacted against the ejection panel by the packing plate of the tailgate. The ejection panel is supported by a telescoping ejection cylinder, and a relief valve is connected to the telescoping ejection cylinder such that the ejection plate can move forwardly as the pressure exerted by the refuse material on the ejection panel and as the internal pressure in the ejection cylinder exceeds a predetermined pressure.

One of the problems with this prior art arrangement lies in the use of a telescopic cylinder to control the ejection panel. When the first refuse material loads are compacted in the unit, the ejection panel is at the rear of the truck body with the telescopic cylinder fully extended. The force on the rear face of the ejection panel necessary to cause the predetermined pressure in the ejector cylinder for release will be this predetermined pressure multiplied by the cross-sectional area of the smallest stage of the telescopic cylinder. As the truck body fills and the ejection panel moves forwardly in the body, the larger stages of the telescopic cylinder come into use. Due to the larger cross-sectional area of these telescopic cylinder stages, the force necessary to cause the panel to release is larger. As a result, as the truck body is filled, greater force must be applied to the ejection panel to cause it to release. Due to this condition, it is not possible to provide for the application of maximum compaction forces for the early stages of compaction because as the body becomes filled, there would be insufficient force available to move the larger stages of the telescopic ejection cylinder. As a result, smaller initial compaction forces must be used with attendant loss of compaction efficiency.

Attention is also directed to the McCarthy U.S. Pat. No. 3,556,324 showing another refuse packing system and a pilot operated unloading valve arrangement for controlling the forward movement of the ejection panel. The pilot operated unloading valve arrangement included in the McCarthy structure seeks to cure the deficiencies of the structure shown in the Urban patent. The McCarthy arrangement connects a pilot operated unloading valve to the packing side of the packing cylinder such that when the pressure in this side of the packing cylinder reaches a predetermined packing pressure, the pilot operated unloading valve relieves the ejector cylinder, thereby allowing the ejector panel to move forwardly. With this arrangement, the only time the ejector cylinder can relieve is when the pressure in the packing side of the packing cylinder exceeds the setting of the pilot operated unloading valve. This arrangement does not provide for interruption of the exhaust of the hydraulic fluid from the ejector cylinder when the packing control valve has been moved to a neutral position and there is a high fluid pressure in the packing cylinder due to the compressed refuse material maintaining back pressure on the packing cylinder. In the event this back pressure exceeds the pilot operated unloading valve setting, the ejector panel can unload after the packing cycle has ceased, thus reducing compaction efficiency.

In another embodiment of the structure shown in McCarthy, the pilot operated unloading valve is connected to the pump pressure line rather than to the packing cylinder. This arrangement functions in the same manner as the first embodiment, provided that the highest circuit pressure in the pump pressure line is generated by the packing pressure. The hydraulic circuit design has to be such that this is the case or premature unloading of the ejection panel could occur. In addition, the use of mechanical controls, the existence of transient pressure peaks or spikes, and pressure drop in the hydraulic lines between the pump and the tailgate can allow the ejection cylinder to unload prematurely, thereby permitting the ejection panel to move forwardly before the area behind the ejection panel has been completely filled with compacted refuse material.

SUMMARY OF THE INVENTION

The present invention provides an improved apparatus for controlling the compaction of refuse in a refuse collection truck, and an improved apparatus for controlling the operation of an ejection panel of a refuse collection truck so as to maximize the efficiency of compaction of refuse in the truck. The apparatus for controlling the operation of the ejection panel includes a valve arrangement providing for gradual forward movement of the ejection panel as refuse is compacted into the truck, thereby maintaining a predetermined pressure on the refuse compacted into the truck and preventing forward movement of the ejection panel prior to complete compaction of refuse material in the truck container.

More particularly, the present invention comprises a means for permitting hydraulic fluid to be vented from the ejector cylinder only when the fluid pressure at the output of the pump exceeds a first predetermined fluid pressure and further when the fluid pressure in the packing end of the packing cylinder exceeds a second predetermined fluid pressure. This means for causing hydraulic fluid pressure to be vented from the ejector cylinder consists of a combination pilot operated sequence valve and pilot operated relief valve operably connected to the ejector cylinder and for selectively venting hydraulic fluid from that cylinder. This combination sequence-relief valve is operably connected by a first pilot line to the hydraulic fluid pump and operably connected by a second pilot line to the packing end of the packing cylinder. This combination sequence-relief valve is constructed such that hydraulic fluid can be vented from the ejector cylinder through the combination sequence-relief valve to the hydraulic fluid tank or reservoir only when the pressure output by the hydraulic fluid pump exceeds a first selected hydraulic pressure, and secondly when the pressure in the packing end of the packing cylinder exceeds a selected hydraulic pressure.

In one embodiment of the invention the main pressure relief valve for the hydraulic system of the refuse collection truck can be set, for example, at 2600 p.s.i. The combination sequence-relief valve for controlling exhaust of hydraulic fluid from the ejector cylinder can then be set such that the hydraulic fluid will be vented from the ejector cylinder when the pressure at the output of the pump exceeds, for example, 2000 p.s.i. and when the pressure in the packing end of the packing cylinder exceeds 2500 p.s.i.

By requiring the pressure at both the pump and at the packing cylinder to exceed selected values before hydraulic fluid can be released from the ejector cylinder, transient pressure peaks, spikes, and the pressure drop between the pump and the tailgate will not interfere with the proper operation of the ejector panel. In addition, other accessories on the truck such as hydraulic container mechanisms, etc. can be operated at system relief pressure with no danger of unloading the ejection panel.

This arrangement also provides for interruption of the exhaust of hydraulic fluid from the ejection cylinder when the packing cylinder control valve has been moved to a neutral position. In operation of the refuse packing structure, even after the packing cylinder control valve has been shifted to neutral, a high fluid pressure can be maintained in the packing cylinder because the compressed refuse material may maintain back pressure on the packing cylinder. The apparatus embodying the present invention precludes this back pressure from opening the ejector unloading valve (combination sequence-relief valve) since even though the pilot pressure from the packing cylinder may exceed the opening pressure of the relief valve portion of the combination sequence-relief valve, the pump pressure will be well below the sequence valve setting of the combination sequence-relief valve due to the fact that the packing valve is in neutral. Since it is necessary that both valves of the combination sequence-relief valve be open before oil can pass through this combination sequence-relief valve, the ejector cylinder will not relieve.

Various other features and advantages of the invention will be apparent by reference to the following description of a preferred embodiment, from the claims and from the drawings.

Figure 1:
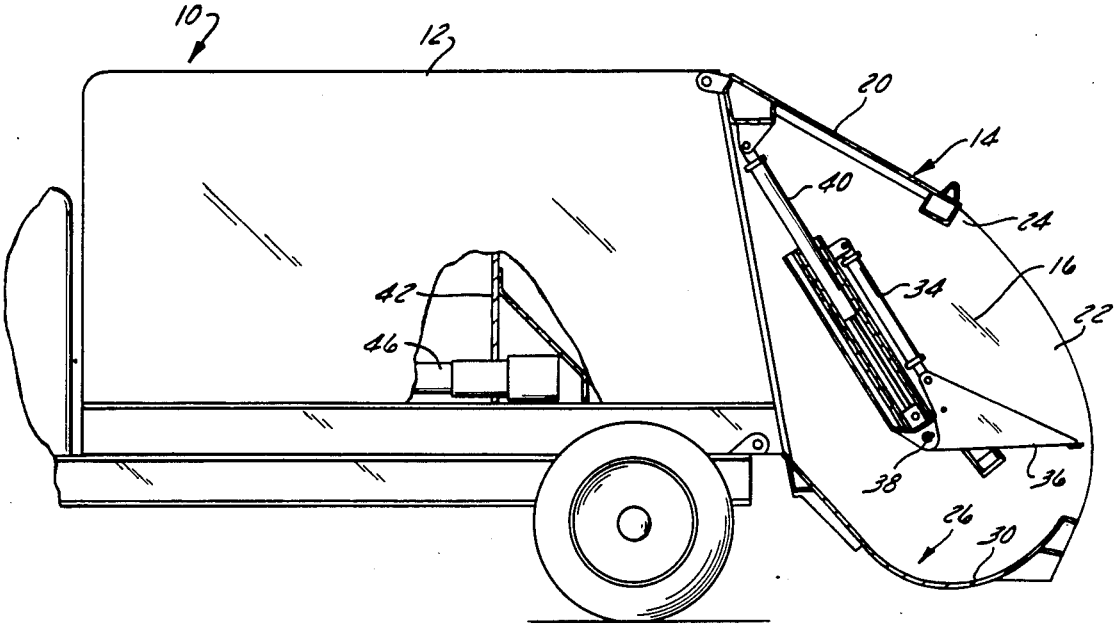
FIG. 1 is a perspective view of a refuse collection truck embodying the present invention.
Figure 3:
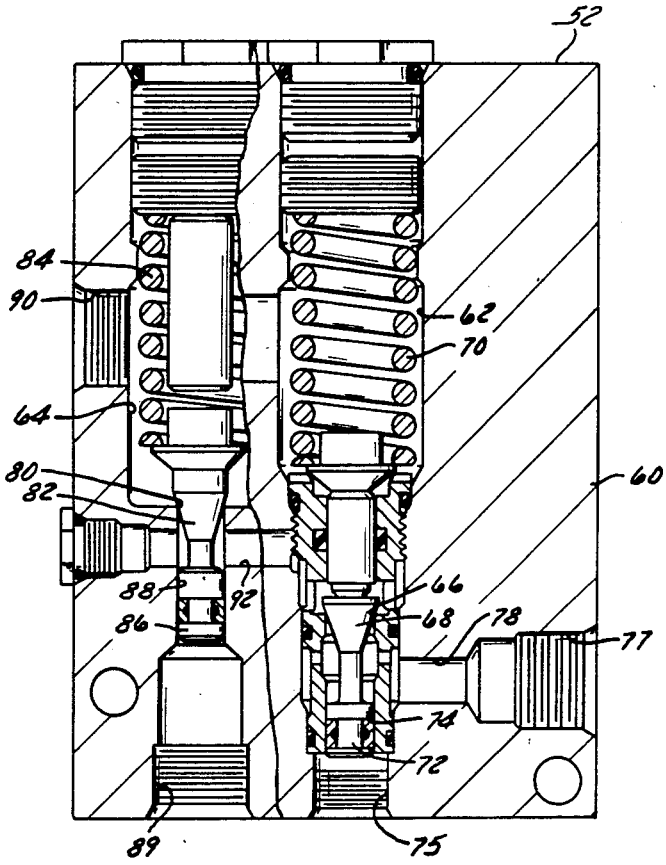
FIG. 3 is an enlarged cross section view of the combination sequence-relief valve shown in FIG. 2.

Before describing a preferred embodiment of the invention in detail, it is to be understood that the invention is not limited to the details of construction and to the arrangement of the components set forth in the following description nor illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

FIG. 1 illustrates a refuse collection vehicle 10 of the type illustrated in the U.S. Weischel et al. U.S. Pat. No. 3,682,336 and including a refuse storage container 12 open at its rearward end. A tailgate unit 14 is hingedly joined to the rearward end of the refuse storage container 12 and is supported for swinging movement between a position shown in FIG. 1 and a raised unloading position wherein refuse material can be ejected from the refuse storage container 12. The tailgate unit 14 includes spaced apart side walls 16 connected at their lower portions by a bottom plate 30 and connected at their upper portions by a sheet metal plate 20. An opening 22 between the bottom plate 30 and the lower edge 24 of the curved sheet metal plate 20 permits loading of refuse into the tailgate unit 14. In the particular embodiment of the invention shown in the drawings, the bottom plate 30 of the tailgate unit 14 defines a hopper 26 for receiving refuse material.

In the illustrated embodiment, the tailgate unit 14 also includes a swingable packing plate 36 supported for movement between a retracted position and a position wherein the packing plate 36 forces refuse material in the hopper 26 into the open end of the container 12. Hydraulic packing cylinders 34 and 40 are provided for causing packing movement of the packing plate 36 in the manner illustrated in the Weischel et al. U.S. Pat. No. 3,682,336.

The refuse collection truck 10 also includes an ejector panel 42 housed in the container 12 and supported for movement in a conventional manner between the forward end of the container 12 and the open rearward end of the container. The ejector panel 42 is generally perpendicular to the floor of the container 12 and moves between the forward and rearward portions of the truck container.

Figure 2:
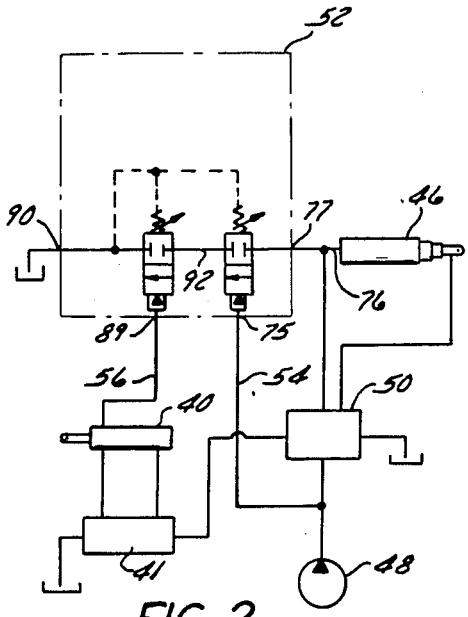
FIG. 2 is a schematic view of the ejector panel cylinder included in the refuse collection truck shown in FIG. 1 and hydraulic control valves for controlling the operation of the ejector panel cylinder.

Means are also provided for causing movement of the ejector panel 42 from the position adjacent the forward end of the container and the rearward open end of the container to thereby provide for unloading of the refuse material from the container. In a preferred form of the invention, the means for causing movement of the ejector panel 42 can include a telescoping hydraulic ejection cylinder 46. The ejection cylinder 46 is operably connected to the hydraulic fluid pump 48 (FIG. 2) and to an ejection control valve 50 such that hydraulic fluid can be selectively forced into the ejection cylinder 46 to cause rearward movement of the ejector panel 42 and discharge of refuse material from the truck container 12.

Means are also provided for selectively exhausting controlled amounts of hydraulic fluid from the telescoping ejection cylinder 46 such that the ejector panel 42 can function as a forward movable wall of the container 12 against which the refuse material can be compressed and compacted by the packing plate 36. The means for selectively exhausting controlled amounts of hydraulic fluid includes means for controlling the exhaust of hydraulic fluid from the ejection cylinder 46 and for permitting exhaust of hydraulic fluid from the ejection cylinder 46 only when the fluid pressure output of the hydraulic fluid pump 48 is above a first selected pressure and when the pressure in the packing end of the packing cylinder 40 is above a second selected pressure. The means for controlling exhaust of hydraulic fluid includes a combination sequence-relief valve 52 connected to the ejection cylinder 46 and functional to permit venting of hydraulic fluid to the hydraulic fluid reservoir from the ejection cylinder 46 and consequent movement of the ejector panel 42 toward the forward end of the container 12 of the truck. The combination sequence-relief valve 52 is operably connected by a first pilot pressure line 54 to the output side of the hydraulic fluid pump 48 and is operably connected by a second pilot pressure line 56 to the packing cylinder 40.

Referring more specifically to the construction of the combination sequence-relief valve 52, while this valve could be constructed in other ways, in the arrangement illustrated in the drawings, the valve includes a combination of an externally pilot operated sequence valve connected to pilot pressure line 54 and an externally pilot operated relief valve connected to pilot pressure line 56, and the externally pilot operated sequence valve and the externally pilot operated relief valve are connected in series. The combination sequence-relief valve 52 includes a valve body 60 including a pair of parallel spaced valve bores 62 and 64. One of the valve bores 62 houses the pilot operated sequence valve. More specifically the valve bore 62 includes a valve seat 66, and a valve member 68 is housed in the valve bore 62 and is engageable with the valve seat 66. A compression spring 70 biases the valve member 68 against the valve seat 66. An opposite end of the valve member 68 includes a piston 72 housed in a cylinder 74. The cylinder 74 is connected through a port 75 and conduit 54 to the pressure side of the pump 48 such that the fluid pressure in the pump 48 will apply a force on the piston 72 tending to force the valve member 68 away from the valve seat 66. The conduit or hydraulic fluid pressure line 76 from the ejection cylinder communicates through a port 77 and bore 78 to the valve bore 62.

The second valve bore 64 houses the pilot operated relief valve and similarly includes a valve seat 80 and a valve member 82 selectively engageable with the valve seat 80. A compression spring 84 biases the valve member 82 against the valve seat 80. An opposite end of that valve member 82 comprises a piston 86 housed in a cylinder 88. The cylinder 88 is connected through a port 89 and conduit 56 to the cylinder 40. The valve bore 64 is also connected to the hydraulic fluid reservoir through a port 90. A transverse bore 92 within the valve body 60 provides fluid communication between a downstream end of the valve bore 62 and an upstream end of valve bore 64.

In operation of the combination sequence-relief valve 52, the force of the compression spring 70 can be set such that a fluid pressure of, for example, 2000 p.s.i. will be required to move the valve member 68 away from the valve seat 66. The compression spring 84 can similarly be set such that a fluid pressure of, for example, 2500 p.s.i. in the line 56 will be required to cause movement of the valve member 82 away from the valve seat 80. If the fluid pressure in the conduit 54 and 56 is in excess of these pressures thereby causing both valve members 68 and 82 to be forced away from the valve seats 66 and 80, respectively, fluid can flow through the port 77 and bore 78 into the valve bore 62, through the transverse bore 92 to valve bore 64 and be discharged through port 90 to the hydraulic fluid reservoir.

If the pressure in either conduit 54 or 56 is less than the pressure required to move either valve member 68 or 82 away from its respective valve seat, fluid flow from the ejection cylinder 46 to the reservoir is prevented. Accordingly, a pressure peak in one of the conduits 54 or 56 will not cause a discharge of hydraulic fluid from the fluid cylinder 46. Since it is necessary for both the sequence valve and the relief valve sections to be actuated before oil can leave ejection cylinder 46.

Various features of the invention are set forth in the following claims.

I claim:

1. Apparatus for use in a refuse collection container having a forward end and an open rearward end, a refuse packing plate supported adjacent said rearward end of the container for forcing refuse material into the container, a first hydraulic cylinder for causing movement of the refuse packing plate between a retracted position and a refuse compacting position, an ejector panel housed in the container and being movable between a forward end of the container and the open rearward end of the container, and a second hydraulic cylinder connected to the ejector panel, the second hydraulic cylinder being extendable to cause movement of the ejector panel toward the open end and being retractable, the apparatus comprising:

a hydraulic fluid operably connected to the first hydraulic cylinder and to the second hydraulic cylinder, a control valve for controlling the supply of hydraulic fluid to the second hydraulic cylinder, means for selectively releasing hydraulic fluid from the second hydraulic cylinder to permit movement of the ejector panel toward the forward end of the container only when both the hydraulic pressure at the hydraulic fluid pump exceeds a first selected hydraulic pressure and when the hydraulic pressure in the first hydraulic cylinder exceeds a second selected hydraulic fluid pressure.

2. Apparatus as set forth in claim 1 wherein said means for selectively releasing hydraulic fluid from said second hydraulic cylinder includes a relief valve connected to said second hydraulic cylinder, said relief valve being connected by a first hydraulic fluid pressure pilot line to said hydraulic fluid pump, and being connected by a second hydraulic fluid pressure pilot line to said first hydraulic cylinder.

3. Apparatus as set forth in claim 2 and wherein the first cylinder has opposite ends and a piston, the piston including a piston rod extending from one of said opposite ends of said hydraulic cylinder, and wherein said second hydraulic fluid pressure pilot line is connected to the end of said hydraulic cylinder containing said piston rod.

4. Apparatus as set forth in claim 2 wherein said relief valve includes an externally pilot operated sequence valve and an externally pilot operated relief valve operably connected in series, said externally pilot operated sequence valve being connected to one of said hydraulic fluid pressure pilot lines, and said externally pilot operated relief valve being connected to the other of said hydraulic fluid pressure pilot lines.

5. A refuse collection truck comprising:

a container having a forward end and an open rearward end, a refuse packing plate supported adjacent said rearward end of said container and supported for movement between retracted position and a refuse compacting position wherein refuse material is compressed and forced into the container, a first hydraulic cylinder for causing movement of said refuse packing plate between the retracted position and the refuse compacting position, an ejector panel housed in said container and supported for movement between a position adjacent said forward end of said container and said open rearward end of said container, a second hydraulic cylinder connected to said ejector panel, said second hydraulic cylinder being extendable to cause movement of said ejector panel toward said open end of said container and being retractable, a hydraulic fluid pump operably connected to said first hydraulic cylinder and to said second hydraulic cylinder, a control valve for controlling the supply of hydraulic fluid to said second hydraulic cylinder, and means for selectively releasing hydraulic fluid from said second hydraulic cylinder to permit movement of said ejector panel toward said forward end of said container only when both the hydraulic pressure at said pump exceeds a first selected hydraulic pressure and when the hydraulic pressure in said first hydraulic cylinder exceeds a second selected hydraulic fluid pressure.

6. A refuse collection truck as set forth in claim 5 wherein said means for selectively releasing hydraulic fluid from said second hydraulic cylinder includes a relief valve connected to said second hydraulic cylinder, said relief valve being connected by a first hydraulic fluid pressure pilot line to said pump, and being connected by a second hydraulic fluid pressure pilot line to said first hydraulic cylinder.

7. A refuse collection truck as set forth in claim 6 and wherein said first hydraulic cylinder has opposite ends and a piston, said piston including a piston rod extending from one of said opposite ends of said cylinder, and wherein said second hydraulic fluid pressure pilot line is connected to the end of said cylinder containing said piston rod.

8. Apparatus as set forth in claim 6 wherein said relief valve includes an externally pilot operated sequence valve and an externally pilot operated relief valve operably connected in series, said externally pilot operated sequence valve being connected to one of said hydraulic fluid pressure pilot lines, and said externally pilot operated relief valve being connected to the other of said hydraulic fluid pressure pilot lines.

9. Apparatus for compacting refuse into a refuse storage container having a forward end and an open rearward end, the apparatus comprising:

a refuse compacting plate supported adjacent the rearward end of the container and movable between a retracted position and a refuse compacting position for forcing refuse material into the container, a first hydraulic motor for causing movement of said refuse compacting plate between the retracted position and the refuse compacting position, an ejector panel housed in the container and supported for movement between a position adjacent the forward end of the container and the open rearward end of the container, a second hydraulic motor connected to said ejector panel, said second hydraulic motor being extendable to cause movement of said ejector panel toward the open end of the container and being retractable, a hydraulic fluid pump operably connected to said first hydraulic motor and to said second hydraulic motor, a control valve for controlling the supply of hydraulic fluid to said second hydraulic motor, and means for selectively releasing hydraulic fluid from said second hydraulic motor to permit movement of said ejector panel toward the forward end of the container only when both the hydraulic pressure at said hydraulic fluid pump exceeds a first selected hydraulic pressure and when the hydraulic pressure in said first hydraulic motor exceeds a second selected hydraulic fluid pressure.

10. Apparatus for compacting refuse as set forth in claim 9 wherein said means for selectively releasing hydraulic fluid from said second hydraulic motor includes a combination sequence-relief valve connected to said second hydraulic motor, said combination sequence-relief valve being connected by a first hydraulic fluid pressure pilot line to said pump, and being connected by a second hydraulic fluid pressure pilot line to said first hydraulic motor.

11. Apparatus for compacting refuse as set forth in claim 10 and wherein said first hydraulic motor comprises a hydraulic cylinder having opposite ends and a piston housed in said hydraulic cylinder, said piston including a piston rod extending from one of said opposite ends of said hydraulic cylinder, and wherein said second hydraulic fluid pressure pilot line is connected to the end of said hydraulic cylinder containing said piston rod.

12. Apparatus as set forth in claim 10 wherein said combination sequence-relief valve includes an externally pilot operated sequence valve and an externally pilot operated relief valve operably connected in series, said externally pilot operated sequence valve being connected to one of said hydraulic fluid pressure pilot lines, and said externally pilot operated relief valve being connected to the other of said hydraulic fluid pressure pilot lines.

* * * * *